US005090188A

United States Patent [19]

Lin et al.

[11] Patent Number: 5,090,188

[45] Date of Patent: Feb. 25, 1992

[54] RIDGED RACQUET STRING

[76] Inventors: Tseng Y. Lin, No. 17 Ping Ho Road, Chung Ho City, Taiwan; Sam H. Chen, 13947 Carriage Rd., Poway, Calif. 92064

[21] Appl. No.: 555,524

[22] PCT Filed: Mar. 30, 1990

[86] PCT No.: PCT/US90/01698

§ 371 Date: Jun. 20, 1990

§ 102(e) Date: Jun. 20, 1990

Related U.S. Application Data

[63] Continuation-in-part of Ser. No. 470,706, Jan. 26, 1990.

[51] Int. Cl.[5] ..... D02G 3/34

[52] U.S. Cl. ..... 57/234; 57/232; 57/7

[58] Field of Search ..... 51/200, 210, 229, 223, 51/232, 234, 243, 244, 248–251, 295, 296

[56] References Cited

U.S. PATENT DOCUMENTS

| | | | |
|---|---|---|---|
| 1,659,556 | 1/1928 | Bankwitz | 57/250 |
| 4,055,941 | 11/1977 | Rivers, Jr. et al. | 57/251 X |
| 4,292,835 | 11/1981 | Shimizh | 57/234 X |
| 4,306,410 | 12/1981 | Nakamura et al. | 57/234 |
| 4,530,206 | 7/1985 | Benichon et al. | 57/250 |
| 4,660,364 | 4/1987 | Chiang | 57/210 X |
| 4,860,531 | 8/1989 | Wells et al. | 57/232 X |

FOREIGN PATENT DOCUMENTS

| | | | |
|---|---|---|---|
| 3447608 | 7/1986 | Fed. Rep. of Germany | 57/234 |

*Primary Examiner*—Daniel P. Stodola
*Assistant Examiner*—John F. Rollins
*Attorney, Agent, or Firm*—Calif Kip Tervo

[57] ABSTRACT

A string (10) for a sports racquet, such as a tennis racquet string, is comprised of a string core (20) having a plurality of external ridges (40) bonded thereon for aiding in imparting spin on a ball and for increasing the crossover contact area between strings. The ridges are parallel to one another and extend axially with the string. Preferably, the string and ridges can be circumscribed by a maximum diameter circle (90), preferably of 1.70 millimeters. The process for making the ridged string includes passing a string core (20) through a bath (72) of resin (71), such as nylon, for coating and glueing the core and then through a die (74) shaped so as to form the ridges (40).

21 Claims, 2 Drawing Sheets

FIG. 2
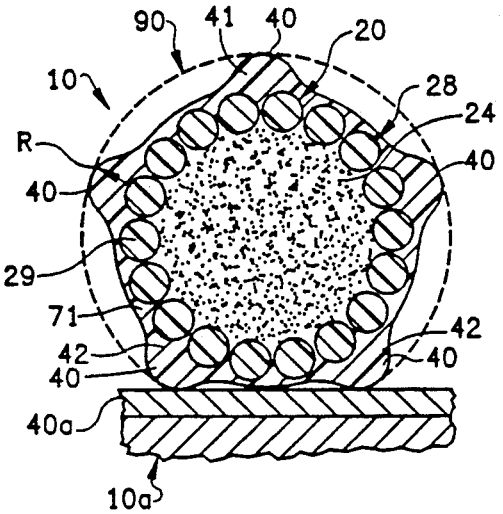
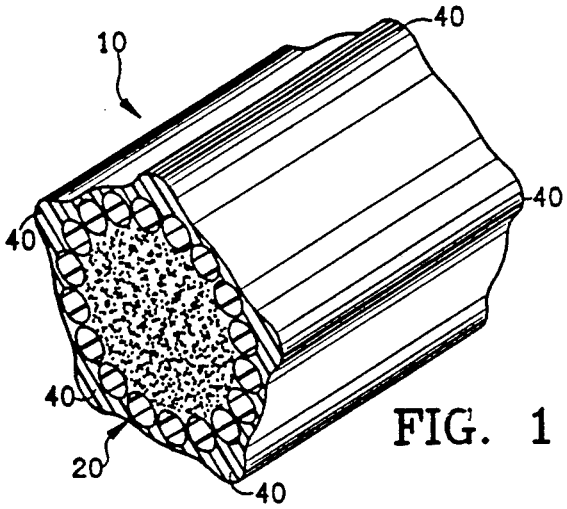
FIG. 1
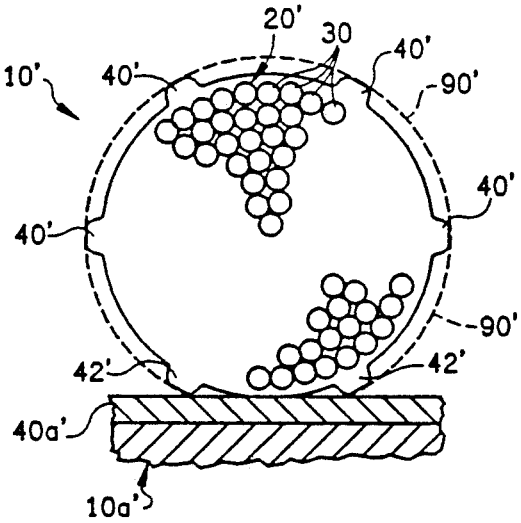
FIG. 4
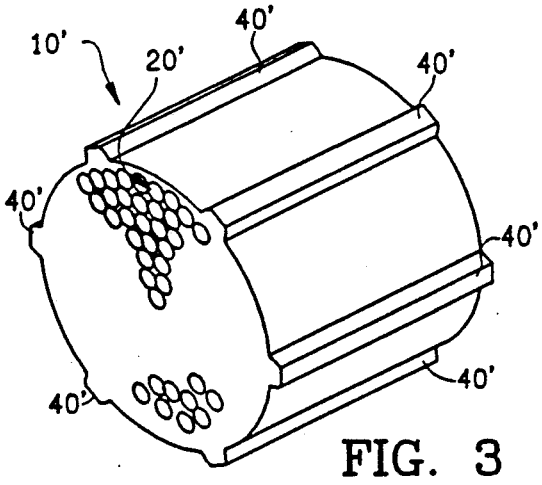
FIG. 3
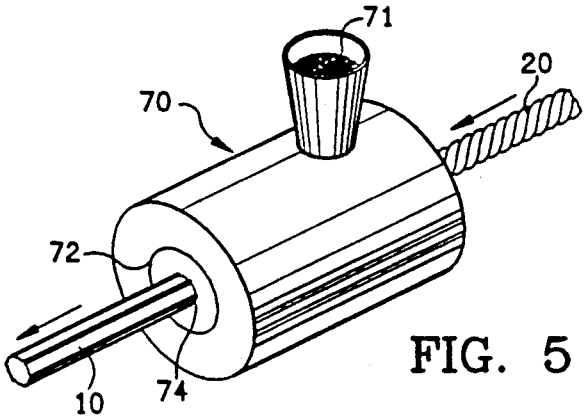
FIG. 5

FIG. 6
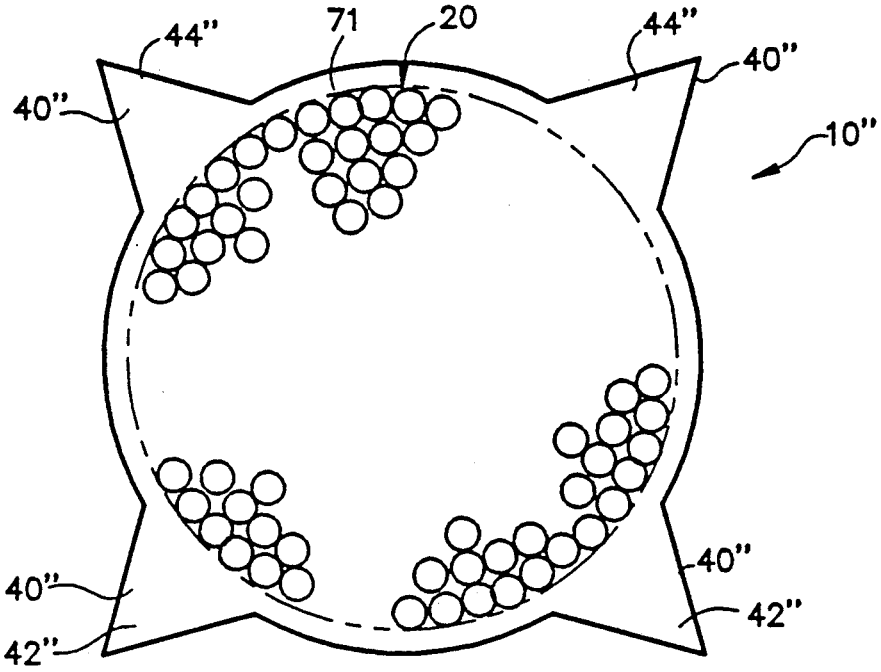
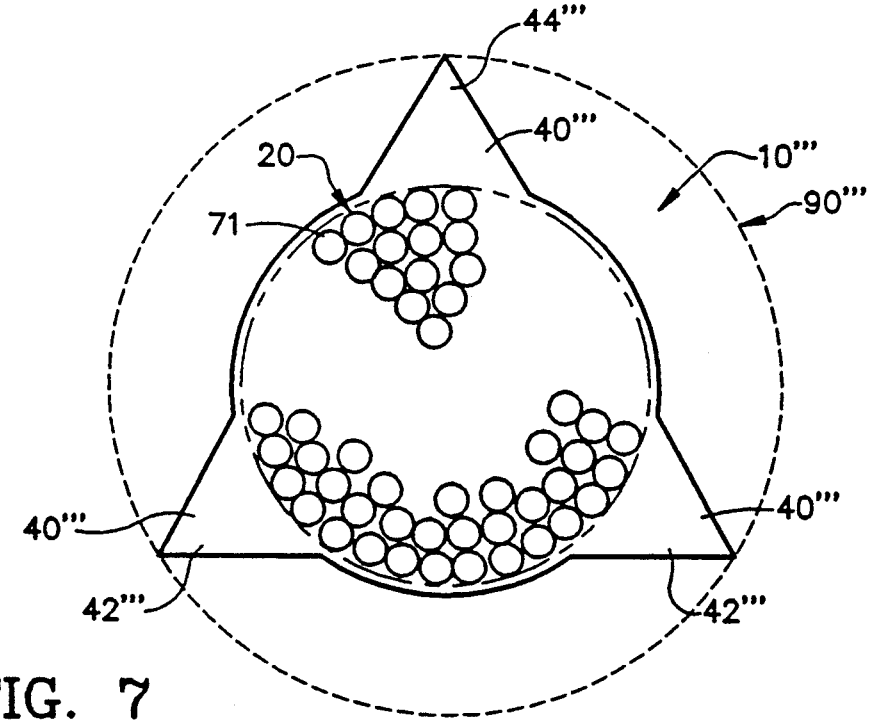
FIG. 7

RIDGED RACQUET STRING

This application is a continuation-in-part of Ser. No. 470,706, filed 01/26/90.

BACKGROUND OF THE INVENTION

1. Field of the Invention

This invention relates in general to a sports racquet string and more specifically involves a string configuration that imparts more spin on the ball and to a method of manufacturing such an improved string.

2. Background of the Invention

The traditional and most popular cross-section of a sports racquet string is round. Such strings are made typically from natural gut (animal fiber) or from synthetic material, such as nylon. Conventionally, strings are constructed by twisting many fine filaments of these materials together, with or without a center filament, into a round core strand and then by passing the core strand through a round die to apply an outer layer coating.

In general, it is desirable that a string exhibit small damping, that is low energy loss and high resilience, and good elasticity, that is a low modulus of elasticity. These elements contribute to the playability of the string. It is also desirable that the string be sufficiently durable.

The diameter of the string is very important as it affects the durability and playability of the string. Generally, thin strings have superior playability. Thin strings exhibit high resilience and good elasticity, and they maintain longer contact with the ball for greater control. However, thin strings may stretch and are more easily broken. On the other hand, thick strings are stronger and more durable but lack the playability of thin strings.

An additional important characteristic of a string is its ability to impart spin on the ball. For example, in the game of tennis, a player standing behind the baseline would have to have a height of about six foot seven to see any of the opponent's court without looking thru the net. This means that most hard-hit balls passing over the net and not having forward spin will land out of bounds over the opponent's baseline. Ball spin affects the ball's flight characteristics. When a ball leaves the racquet string bed spinning forward, i.e. rotating forward on top, it's flight path will tend to curve downward, and it will land earlier and bounce higher. With good top spin, a player can hit a given ball much harder and still have the ball land in. When a ball leaves the racquet string bed spinning backward, i.e. rotating forward on bottom, its flight path is flatter; it will tend to land further and bounce lower. Thus, if the player can control spin, the player can control to some degree the trajectory of the ball to advantage.

Again, string characteristics largely determine the amount of spin that can be imparted on the ball. As previously mentioned, the amount of string elongation and resilience determines the amount of time the strings are in contact with the ball. Generally, the thinner the string, the greater the contact time. When the ball impacts on the racquet face, the ball remains in contact with the string bed for about three to five thousandths of a second. During this time, the player is able to impose more control over the direction of ball return and is able to impart spin to the ball to control its flight characteristics.

To put spin on the ball, the ball is struck with the racket face at an angle to the flight path and the racket face is moved in the plane of the face. Increasing the friction between the strings and the ball has been thought to enhance imparting spin on the ball.

Synthetic fiber strings, in particular, are excessively smooth in their outer surface and tend to slip over the ball. Many measures have been taken to enhance friction including roughening the outer surface of the string such as by grinding with abrasives, surface coating the string with frictional or rubbery substances, twisting or braiding fiber multifiliments, and winding of silk yarns around the string core.

Synthetic strings treated in the above-described manners tend to have poor dimensional stability and are reduced in strength and elasticity resulting in tension loss during play. Further, some are inferior in durability because they exhibit surface aberrations, wearings or breakages due to degredation of the resins, and abrasion, peeling or denaturing of the treating substances. Moreover, since the above-mentioned treatments constitute additional steps in manufacture, there is an increase in production costs.

Another proposed method to increase string friction is the use of string of polygonal cross-section whereby the sharp corners resulting at the juncture of the faces of the polygon are the spin enhancing portions. Two types of polygonal-shaped string have been proposed. Reta, U.S. Pat. No. 4,805,393 proposes the use of a multi-sided cross-sectional configuration string; Wells, U.S. Pat. No. 4,860,531, proposes a polygonal coating over a round central core.

Traditional round strings may have a thin, evenly distributed coating around the core to provide protection to the core strands which provide the tensile strength and playability of the string.

As two round strings cross over one another, due to the very small contact area they weaken one another by indenting one another and by cutting one another in a sawing action as the strings move relative to one another during play.

Therefore, it is desirable to have an improved sports racquet string having much better spin-imparting characteristics than a conventional round string and which achieves this without significant loss in playability.

It is further desirable, that such a string reduce the weakening characteristics of string cross-over and therefore be more durable than conventional strings.

SUMMARY OF THE INVENTION

According to the invention, a string for a sports racquet, such as a tennis racquet string, is comprised of a core having a plurality of ridges thereon for aiding in imparting spin on a ball. The ridges are parallel to one another and extend axially with the string. Preferably, the inner core has a diameter of 1.00–1.30 millimeters. Preferably, the ridges are of approximately 0.25 millimeters in height. Preferably, the ridges can be circumscribed by a circle of 1.70 millimeters.

The process for making the ridged string includes passing a string core through a bath of resin, such as nylon, for coating and glueing the core and then through a die shaped so as to form the ridges.

Preferably the size, spacing, and number of the ridges increase contact area between strings at the cross-over points and add to the stability to prevent string rotation and movement relative to one another.

Other features and many attendant advantages of the invention will become more apparent upon a reading of the following detailed description together with the drawings in which like reference numerals refer to like parts throughout.

BRIEF DESCRIPTION OF THE DRAWING

FIG. 1 is a perspective view of a segment of a preferred embodiment of the ridged racquet string of the invention.

FIG. 2 is a slightly enlarged cross-sectional view of the string of FIG. 1 shown passing over a similar string, such as while strung on a racquet.

FIG. 3 is a perspective view of a segment of an alternate exemplary embodiment of the ridged racquet string of the invention.

FIG. 4 is a slightly enlarged cross-sectional view of the ridged string of FIG. 3 shown passing over a similar string, such as while strung on a racquet.

FIG. 5 is a view of the extrusion step in the manufacture of the ridged string of the invention.

FIG. 6 is a cross-sectional view of an alternate preferred embodiment of the ridged racquet string of the invention; this one having four triangular ridges.

FIG. 7 is a cross-sectional view of another alternate exemplary embodiment of the ridged racquet string of the invention; this one having three triangular ridges.

DETAILED DESCRIPTION OF THE INVENTION

With reference now to the drawing, and more particularly to FIG. 1 thereof, there is shown, in perspective view, a segment of a preferred embodiment of the ridged sports racquet string, denoted generally as 10, of the present invention. Ridged string 10 includes a core, denoted generally as 20, and a plurality of ridges 40 bonded to the core 20. Ridges 40 run axially with length of the string and are parallel to one another.

Turning now to FIG. 2, the ridged string 10 of FIG. 1 is shown in cross-section with the addition of showing the string 10 as it crosses over a similar string **10*a* such as it would in a strung racquet. The cross-over point of FIG. 2 is simplified in that it does not show the true intermeshing of the strings 10,10*a* and their ridges 40,40*a*** in the strung condition. At cross-over, the string cores and ridges indent one another and the string cores and ridges protrude into the concavities between the ridges and core of the cross-over string. This intermeshing prevents rotation of the strings relative to one another.

In the preferred embodiment shown, the string core 20 made of construction well-known in the art. Core 20 is of synthetic material and is of composite construction comprising an inner core 24 and and an outer core 28.

An inner core can be a thick extruded monofilament or be of the "fiber" type. Inner core 24, shown, is of the "fiber" type and comprises a multiplicity of of small diameter monofilament fibers or strands which are twisted and glued together to form the inner core structure. The small monofilament fibers need not be continuous as the friction of the package prevents slippage. In cross-section, a fiber inner core typically contains five hundred to three thousand fibers.

Many synthetic materials are available for such use including nylon, polyester, kevlar, zyex (polyetheretherketon), boron, and graphite fiber. Various glue compositions are well-known in the art. A common glue for synthetic fiber is nylon resin. After glueing, inner core 24 is cured, such as at 150 degrees C. for two minutes Inner core 24 is helically wrapped by a layer of larger strands 29 which form an outer core 28. If the outer core is formed by two or more layers of large strands, then adjacent layers are helically wound in opposite directions.

As best seen in FIG. 5, the string core 20 is processed by passing it through a bath and die apparatus, denoted generally as 70. String core 20 is immersed in a bath 72 of suitable molten ridge forming material, such as nylon 71, and, upon exiting the bath 72 is passed thru a die 74 which leaves the desired nylon ridges 40 remaining. The nylon also acts as a glue, fills voids in the core, and forms a thin coating over the core. String 10 is than cooled, such as by water at 20 degrees C. The resulting string can be further processed, such as for moisture control or thermosetting, as desired.

Returning once more to FIG. 2, the results of the bath and die processing can be seen in cross-section. Nylon 71 from bath 72 acts as a glue and coating for the core 20. Extrusion die 74 has left ridges 40 bonded to the outside of the core and extending parallel axially with the string. In the exemplary embodiment of FIG. 2, five evenly spaced ridges are shown. Ridges 40 are arc-shaped and project radially outward from core 20. Ridges 40 impart more spin on a struck ball.

Preferably, ridges 40 may be circumscribed by a maximum diameter circle 90, shown in dashed line. FIG. 2 is an enlarged view of a sting having a core 20 of 1.20 millimeters and a maximum diameter circle of 1.45 millimeters. Preferably, the largest maximum diameter circle is 1.70 millimeters.

The height, shape, and spacing of ridges 40 are important. Unless the maximum diameter circle 90 has a diameter 0.15 millimeters greater than the core, so that the ridges are at least 0.075 millimeters in height, the ridges are too small to be effective. Ridge heights of about 0.25 millimeters have been found to produce good results. A core diameter of 1.00–1.30 millimeters with a maximum diameter circle of 1.35–1.70 millimeters has been found to impart superior spin without detracting from the other aspects of playability and therefore seems preferable.

The ridge radius is the outer arc of the ridge 40. A ridge radius R of the difference between the radius of the maximum diameter circle 90 and the radius of the core 20 has been found to provide a desirable combination of good playing characteristics and ridge longevity. If the ridges 40 are too pointed on the outer end or too narrow in width, they are quickly worn down or damaged by play and they loose their effectiveness. A large ridge radius is not as effective at spin enhancement and the added thickness of coating makes the string stiffer and less playable. Too large a ridge height makes the string difficult to string on a racquet and also adds to the string stiffness.

Preferably, between ridges, the glue coating over outer core 28 is of just sufficient thickness to prevent abrasion of the core structure during play and increase the contact area of the cross-over point, and therefore between ridges the outside of the coated string assumes the arc of the string core. The area where the ridges join the inner core coating is faired to add strength and prevent breakage of the ridges.

Also in FIG. 2, ridged string 10 is shown crossing over itself or another similar ridged string **10*a* having ridge 40*a* as strung on a racquet. The string contact ridges 42 increase the contact with the cross string 10***a*. The larger contact area reduces the extent to which the strings will indent one another at the crossover point. The indenting tends to weaken the strings and lowers string life. There is a sewing effect caused by the strings moving over one another as the ball is hit. Sewing also wears, cuts and weakens strings. The larger contact area with the five ridge configuration lessens the sewing effect.

The crossover points are the highest points on the face of the racquet and exert the greatest forces on the ball. With the five ridge configuration, at string cross-overs the strings assume the position shown in FIG. 2. This is a very stable position and is thought to prevent string 10 from rotating when it encounters the ball. Imparting spin to the ball applies rotational forces to the string. The better the string resists these rotational forces the greater should be the spin on the ball.

Also, in the five ridge configuration, outermost ridge 41 and both of the adjacent ridges are in good position to impart spin on a ball.

Also, although in the drawings the strings have been shown in cross-section at a string cross-over point and ridges have been designated as "outermost ridges" and "ball contact ridges" or as "string contact ridges"; it should be clear that a given ridge may change from one to the other at adjacent cross-over points and, in fact, this seems desirable as the string does not thereby need to rotate Turning now to FIGS. 3 and 4 there is illustrated an alternate exemplary embodiment of ridged racquet string, denoted generally as 10', of the invention; this one having six ridges. FIG. 3 is a perspective view of a segment of a six ridged string FIG. 4 is a slightly enlarged cross-sectional view of the six ridged string 10' of FIG. 3 shown passing over a similar string 10*a* ', such as while strung on a racquet.

The six ridged string 10' includes a core, denoted generally as 20', and a plurality of ridges 40' bonded to the core 20'. Ridges 40' are preferably evenly spaced, run axially with length of the string and are parallel to one another. Six ridged string 10' is produced the same as the five ridged string except by use of a different die.

Turning now to FIG. 4, the six ridged string 10' of FIG. 3 is shown in cross-section with the addition of showing the string 10' as it crosses over a similar string 10'*a* such as it would in a strung racquet. In this exemplary embodiment, the string core 20' is made also of construction well-known in the art. Core 20' is comprised of a multiplicity of continuous large monofilaments 30 which are twisted and glued together to form the core 20'. There is no inner or outer core as in the exemplary five ridged string 10.

FIG. 4 illustrates a core diameter of 1.30 millimeters and a maximum diameter circle 90' of 1.45 millimeters.

In the exemplary embodiment shown, ridges 40' are tooth-like in cross-section and project radially outward from core 20'. Preferably, toothed ridges 40' are about twice as wide as they are high for prevention of wear and breakage.

Six ridged string 10' also produces a large cross-over contact area which reduced indentation and sewing. The two contact ridges 42' also help the string to resist rotation upon ball impact and upon imparting spin. The cross-over point of FIG. 4 is simplified in that it does not show the true intermeshing of the strings 10',10*a*' and their ridges 40',40*a*' in the strung condition. At cross-over, the string cores and ridges indent one another and the string cores and ridges protrude into the concavities between the ridges and core of the cross-over string. This intermeshing prevents rotation of the strings relative to one another.

FIG. 6 illustrates another preferred embodiment of the invention. FIG. 6 is a cross-sectional view of a racquet string 10" having four spaced ridges 40". Core 20 is of conventional nature, such as illustrated and described heretofore with regard to FIGS. 1–4. Glue, such as nylon resin 71, surrounds core 20 and forms ridges 40". FIG. 6, illustrates a core diameter is 1.20 millimeters, and a maximum diameter circle of 1.70. Thus, ridges 40" are 0.25 millimeters in height. Ridges 40", as illustrated, are triangular in shape with an apex angle of sixty degrees. Preferably, the apex angle is less than ninety degrees. Too small an apex angle leads to rapid wear of the ridge, and an apex angle of about sixty degrees appears to be optimum. A truncated cone-shaped ridge of the same height wears better than the pointed ridge illustrated. Further testing is required to determine, for a given maximum diameter circle, under what conditions each produces the superior result.

As strung, two of the ridges 40", designated here as 42", are string contact ridges that will contact the cross-over string. Considerable deformation of the string core and ridges occurs at cross-over. String contact ridges 42" interlock with the cross-over string string contact ridges and prevent the string 10" from rotation upon ball contact. The intermeshing of the ridges of the cross-over strings at the cross-over point is thought to reduce relative string movement. The intermeshing of string contact ridges 42" prevent the string from rotation upon ball contact such that the ball contact ridges 44" remain in position to impart maximum rotational force on the ball. The lack of rotation greatly reduces wear of the strings at the cross-over point.

In the four ridge example of FIG. 6, ball contact ridges 44" are in particularly good position to impart spin on a ball coming from either direction relative to the string. That is a ball upon which spin is imposed will encounter one of the contact ridges first and with much greater force than the other ridge which is only incidentally contacted.

FIG. 7 illustrates yet another exemplary embodiment of the ridged racquet string of the invention. FIG. 7 is a cross-sectional view similar to FIG. 6 with a change in diameters and in number of ridges. The string 10''' of FIG. 6 has an inner core 20 of 1.00 millimeters and three ridges 40''', each of height 1.00 millimeters, such that the string may be circumscribed by maximum diameter circle 90''' of 1.55 millimeters. String contact ridges 42''' interlock with the string contact ridges of the cross-over string to prevent rotation. Ball contact ridge 44''' imparts spin on a ball approaching from either direction.

The string 10" with four ridges appears to be particularly suited for several reasons. First, two of the ridges are always idealy spaced for intermeshing with the cross-over string, for providing a wide intermeshed contact base to prevent rotation. Second, the ball contact ridges are thought to be located so as to provide maximum ball contact spin, i.e. at the outer "corners" of the string. Third, the string need not rotate while stringing the racquet. That is, at the seceeding cross-over point, the ball contact ridges simply become the string contact ridges and vice versa. This allows the ball contact strings to always be in the desired position. For contra example, the three ridged string needs to be rotated between cross-over points.

The ridged racquet string of the present invention will impart much more spin on the ball than conventional round or polygonal strings without noticeable loss of other desirable playability characteristics.

Preliminary testing indicates that the ridged racquet string of the present invention will last over fifty percent longer than a similar round string. This appears to result primarily from the non-rotation of the string at cross-over.

Although the exemplary embodiments illustrate a fiber inner core 24 with an outer core 28 of .multiple large monofilaments 29 helically wrapped around it, and core 20' of a multiplicity of large monofilaments, as will be seen, the invention is applicable other core structures, such as an core of a single large monofilament surrounded by a wrapping.

As used herein, the words "string core" alone without further limitation applies to the string structure being inserted into the resin bath and die apparatus 70 and includes "core-less" string such as string formed by twisting together large monofilaments, or having a synthetic "fiber" core only with no outer core. The invention is also adaptable for use with natural fibers, such as gut, forming the string core.

Also, although in the drawings the strings have been shown in cross-section at a string cross-over point and ridges have been designated as "ball contact ridges" or as "string contact ridges"; it is reiterated that a given ridge may change from one to the other at adjacent cross-over points and , in fact, this seems desirable as the string does not thereby need to rotate.

Although particular embodiments of the invention have been illustrated and described, various changes may be made in the form, construction and arrangement of the elements herein without sacrificing any of its advantages. Therefore, it is to be understood that all matter herein is to be interpreted as illustrative and not in any limiting sense and it is intended to cover in the appended claims such modifications and changes as come within the true spirit and scope of the invention.

We claim:

1. A string adapted to be mounted in a frame head of a sports racquet used for striking a playing object comprising:

an elastic, resilient string core of high tensile strength;

a coating of synthetic material bonded to and surrounding said string core; said coating having a plurality of spaced apart, radially protruding ridges extending axially along the string core and in parallel relation to one another and a plurality of arcuate surface portions interconnecting side ridges, wherein said surface portions form a substantially circular perimeter;

said ridges aiding in the imparting of spin to a playing object.

2. The string of claim 1 wherein:

said ridges are greater than 0.075 millimeters in height above the outside of said string between said ridges.

3. The string of claim 2 wherein said ridges are four in number and are evenly spaced about said string.

4. The string of claim 2 wherein said ridges are substantially triangular in transverse cross-section.

5. The string of claim 4 wherein said ridges have an apex angle of less than ninety degrees.

6. The string of claim 1 wherein said ridges six in number.

7. The string of claim 6 wherein said ridges are evenly spaced about said string core.

8. The string of claim 1 wherein said ridges are five in number.

9. The string of claim 8 wherein said are evenly spaced about said string core.

10. The string of claim 1 wherein said ridges in transverse cross-section are arc-shaped.

11. The string of claim 1 wherein said ridges in transverse cross-section are generally arc-shaped with a ridge arc radius of 0.075 millimeters or greater.

12. The string of claim 1 wherein said ridges in transverse cross-section are substantially rectangular.

13. The string of claim 1 wherein said ridges in transverse cross-section are substantially rectangular with a width of twice the height.

14. The string of claim 1 wherein said ridges are three to eight in number.

15. The string of claim 1 wherein said ridges are evenly spaced about said string core.

16. The string of claim 1 wherein said ridges in transverse cross-section are substantially triangular.

17. The string of claim 16 wherein said ridges four in number.

18. The string of claim 16 wherein said ridges have an apex angle of less than ninety degrees.

19. The string of claim 16 wherein said ridges are evenly spaced about said string core.

20. The string of claim 16 wherein said ridge three in number.

21. The string of claim 1 wherein said string core comprises:

an inner core of twisted and glued monofilament strands; and an outer core comprising a plurality of larger diameter strands helically wound about said inner core.

* * * * *